US007318792B1

(12) United States Patent
Chen et al.

(10) Patent No.: US 7,318,792 B1
(45) Date of Patent: Jan. 15, 2008

(54) EXERCISE MACHINE

(75) Inventors: Chih-Liang Chen, No. 66, Alley 71, Lane 252, Sec. 2, Jieshou Rd., Pateh City, Taoyuan Hsien (TW); Chih-Fu Chang, Pateh (TW)

(73) Assignee: Chih-Liang Chen, Pateh, Taoyuan Hsien (TW)

( * ) Notice: Subject to any disclaimer, the term of this patent is extended or adjusted under 35 U.S.C. 154(b) by 0 days.

(21) Appl. No.: 11/558,796

(22) Filed: Nov. 10, 2006

(51) Int. Cl.
*A63B 21/068* (2006.01)
*A63B 21/02* (2006.01)
*A63B 69/06* (2006.01)
*A61H 1/00* (2006.01)

(52) U.S. Cl. ..... 482/95; 482/121; 482/72; 601/56

(58) Field of Classification Search ..... 482/72–73, 482/121–126, 144–146, 95–96; 472/106, 472/110, 113; 601/23, 46
See application file for complete search history.

(56) References Cited

U.S. PATENT DOCUMENTS 2,642,288 A * 6/1953 Bell ..... 482/96
3,380,737 A * 4/1968 Elia et al. ..... 482/72
4,743,010 A * 5/1988 Geraci ..... 482/72
5,547,442 A * 8/1996 Carballosa et al. ..... 482/46
5,569,138 A * 10/1996 Wang et al. ..... 482/130
5,582,567 A * 12/1996 Chang ..... 482/146
5,586,959 A * 12/1996 Adkins et al. ..... 482/96
5,616,109 A * 4/1997 Szu-Ming ..... 482/123
6,149,552 A * 11/2000 Chen ..... 482/72
6,162,153 A * 12/2000 Perez, et al. ..... 482/96
6,652,432 B2 * 11/2003 Smith ..... 482/146
7,108,642 B1 * 9/2006 Stearns ..... 482/140

FOREIGN PATENT DOCUMENTS

GB 2256151 A * 12/1992

* cited by examiner

*Primary Examiner*—Fenn C. Mathew
(74) *Attorney, Agent, or Firm*—James H. Walters

(57) ABSTRACT

An exercise machine that allows an exercise similar to push-ups to be performed safely and has a base, a lever, a pad, a leveling rod, and a resilient element. The base has at least one bracket. The lever is attached pivotally to the bracket and has a front end, a rear end and a handlebar attached to the front end. The pad is attached to the rear end of the lever. The leveling rod is connected pivotally to the bracket and the pad. The resilient element is connected to the pad and the base.

16 Claims, 8 Drawing Sheets

EXERCISE MACHINE

BACKGROUND OF THE INVENTION

1. Field of the Invention

The present invention relates to an exercise machine, especially to an exercise machine that helps a person to safely perform an exercise similar to a push-up.

2. Description of the Prior Art

Push-ups are a common calisthenic exercise. Push-up focuses most of the body weight of an exerciser on his or her triceps muscles. The exerciser's body weight is applied to the triceps muscles during downward and upward movement. A beginning exerciser tends to overestimate his or her capacity and performs too many push-ups, which may damage the triceps muscles.

To overcome the shortcomings, the present invention provides an exercise machine to mitigate or obviate the aforementioned problem.

SUMMARY OF THE INVENTION

The main objective of the invention is to provide an exercise machine that allows an exercise similar to a push-up to be performed safely.

The exercise machine in accordance with the present invention has a base, a lever, a pad, a leveling rod and a resilient element and may have at least one vibrator.

The base has at least one bracket.

The lever is attached pivotally to the bracket and has a front end, a rear end and a handlebar attached to the front end.

The pad is attached to the rear end of the lever.

The leveling rod is connected pivotally to the bracket and the pad.

The resilient element is connected to the pad and the base.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
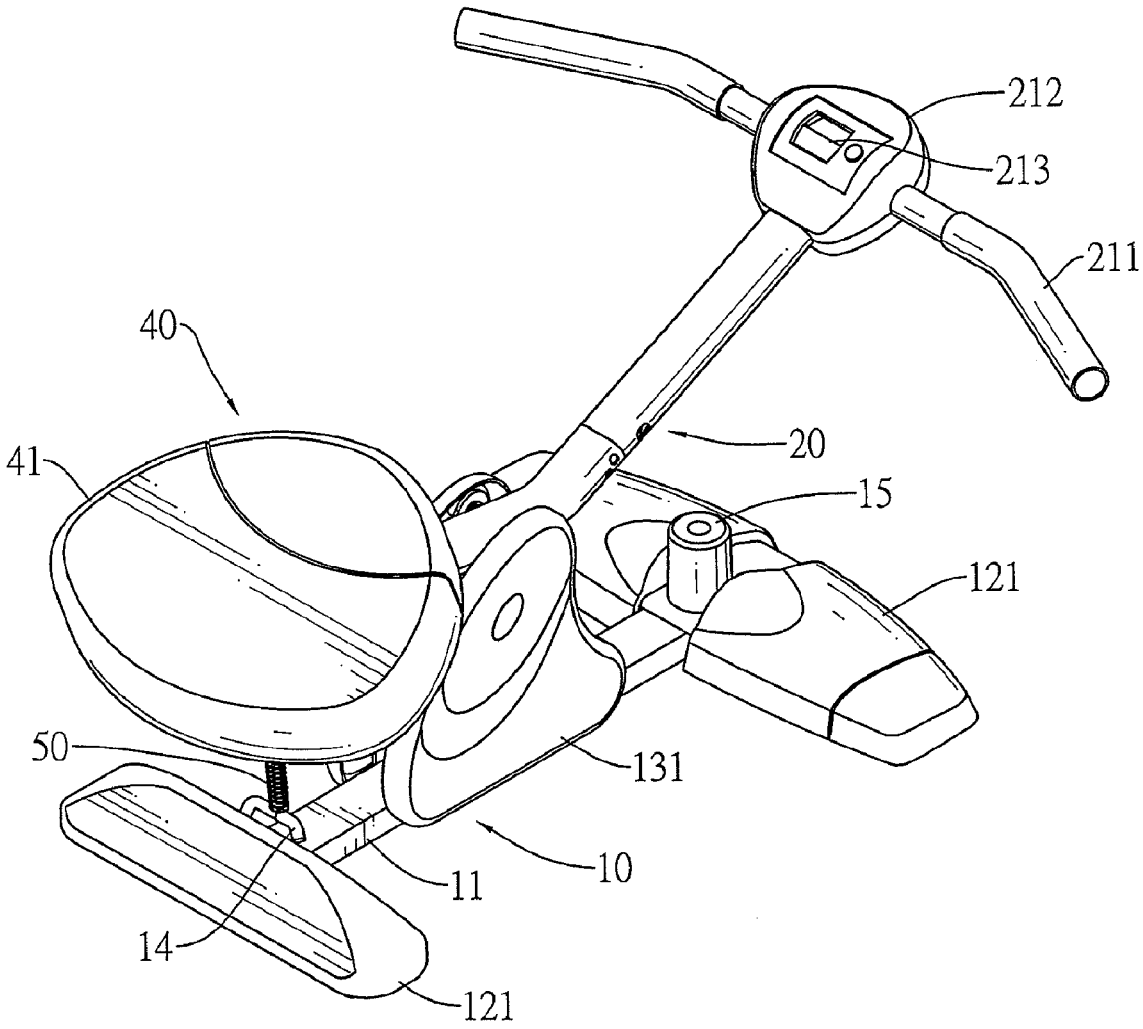
FIG. 1 is a perspective view of the exercise machine in accordance with the present invention.
Figure 2:
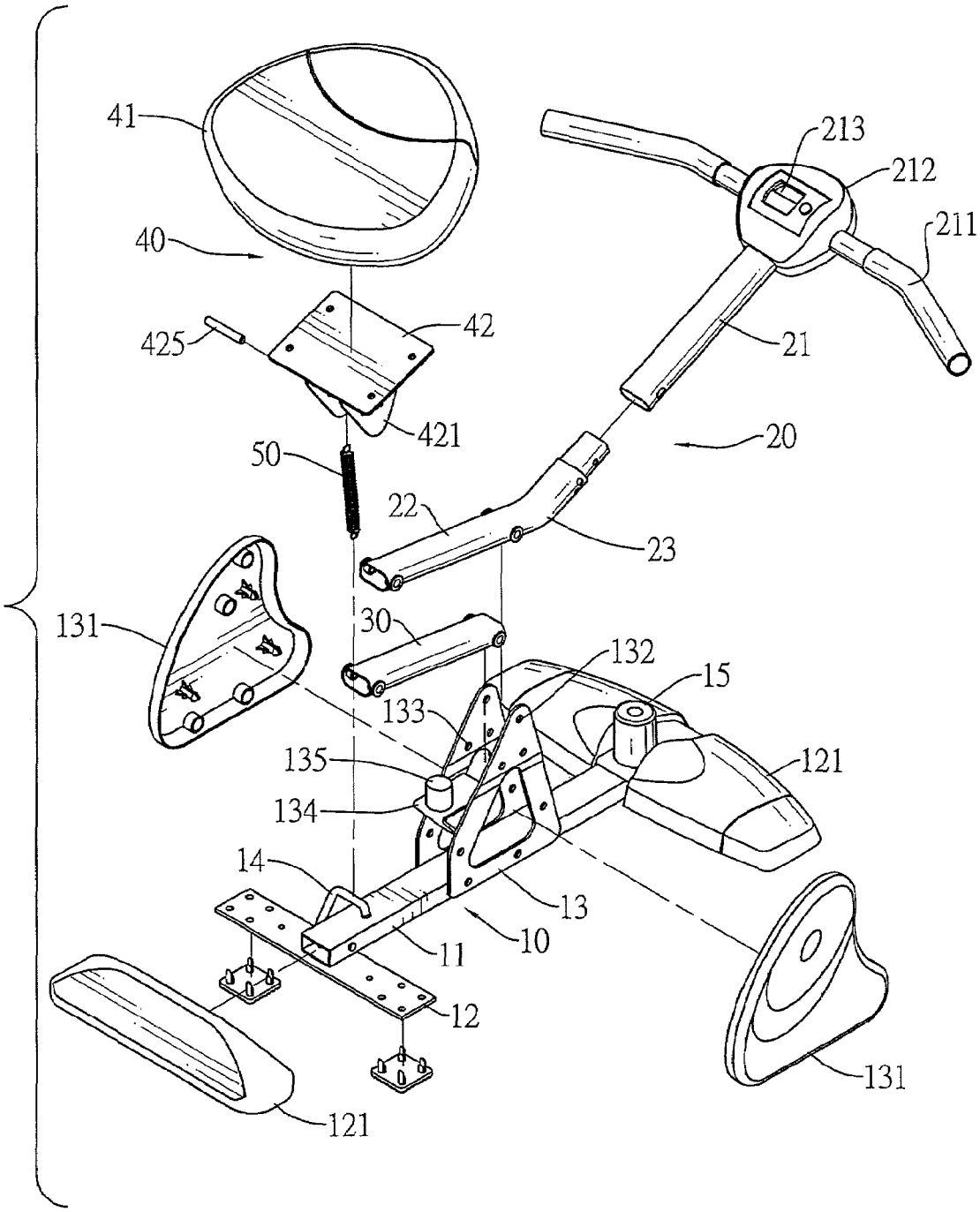
FIG. 2 is an exploded perspective view of the exercise machine in FIG. 1.
Figure 3:
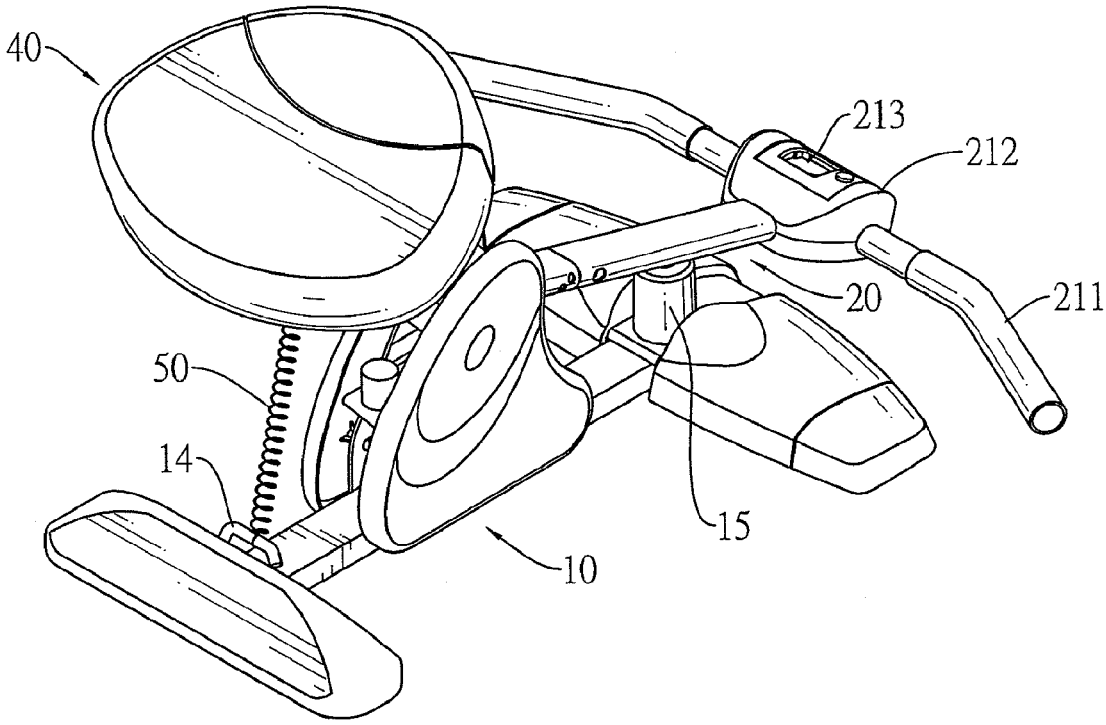
FIG. 3 is a perspective view of the exercise machine in FIG. 1 with the front end of the lever lowered.

With reference to FIGS. 1, 2, 3, 6, and 7 an exercise machine in accordance with the present invention comprises a base (10), a lever (20), a pad (40), a leveling rod (30) and a resilient element (50) and may have at least one vibrator (65).

The base (10) rests on the ground or a solid horizontal surface, has a base bar (11), two crossbars (12), at least one bracket (13) and a connector (14) and may have a bumper (15).

The base bar (11) has a top, a front end and a rear end.

The two crossbars (12) are attached respectively to the front end and the rear end of the base bar (11) and may have a set of covers (121). The covers (121) respectively cover the two crossbars (12).

The bracket (13) is attached to and protrudes up from the base bar (11) between the front end and the rear end of the base bar (11), has two sides, a lever pivot hole (132) and a leveling pivot hole (133) and may have two side covers (131), a bumper seat (134) and a secondary bumper (135). The two side covers (131) are mounted respectively on the sides of the bracket (13). The bumper seat (134) is attached to the bracket (13) and has a top. The secondary bumper (135) is attached to and protrudes up from the top of the bumper seat (134).

The connector (14) is attached to and protrudes up from the base bar (11) near the rear end and may be a hook.

The bumper (15) is attached to and protrudes up from the top of the base bar (11) near the front end.

The lever (20) is attached pivotally to the lever pivot hole (132) in the bracket (13), has a front end, a rear end and a handlebar (211) and may have a front segment (21) and a rear segment (22). The handlebar (211) is attached to the front end of the lever (20) and may have a box (212). The box (212) may have a counter (213).

Figure 4:
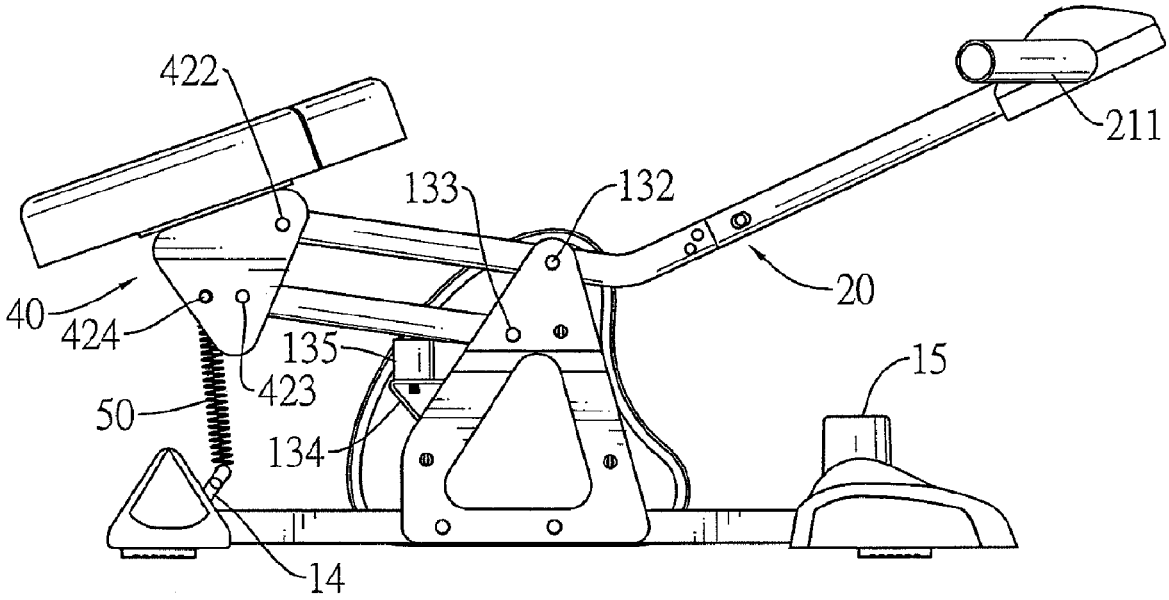
FIG. 4 is a side view of the exercise machine in FIG. 1.
Figure 5:
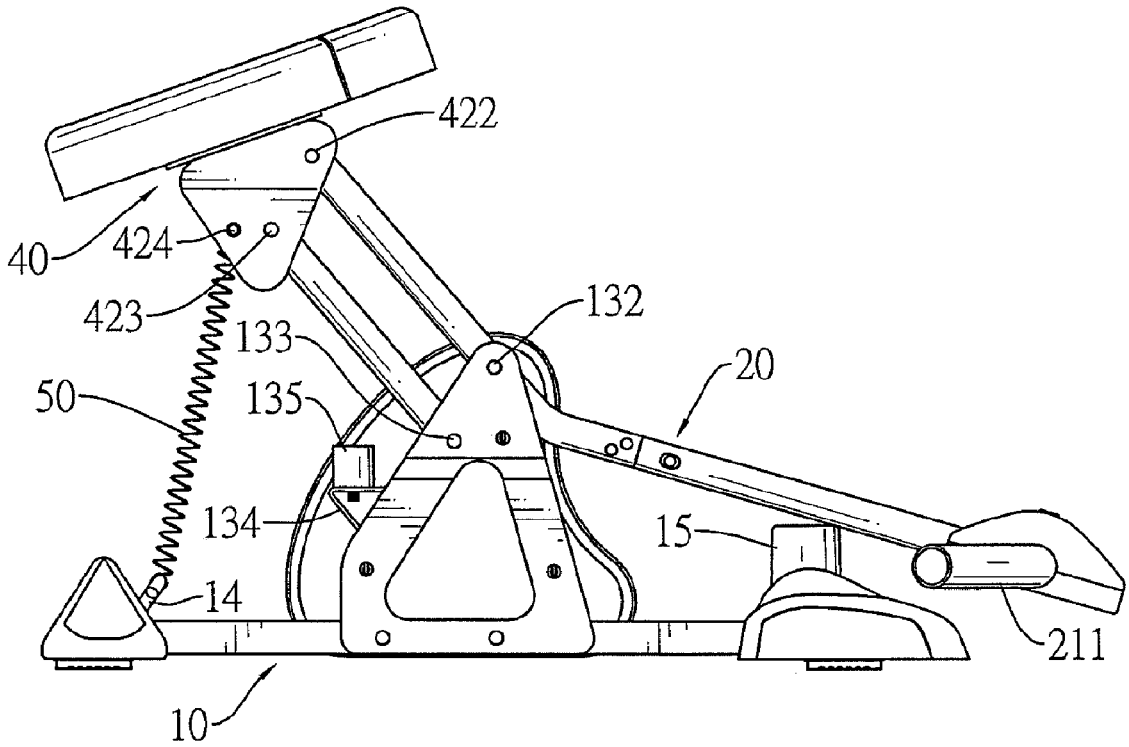
FIG. 5 is an operational side view of the exercise machine in FIG. 1 with the front end of the lever lowered.

With further reference to FIGS. 4 and 5, the pad (40) is attached to the rear end of the lever (20) and has a pad body (41) and a mounting bracket (42). The pad body (41) has a bottom surface. The mounting bracket (42) is attached to the bottom surface of the pad body (41), connects the pad body (41) to the lever (20) and has two wings (421) and a pin (425). The wings (421) protrude down and are connected pivotally to the rear end of the lever (20), and each wing (421) has a lever pivot hole (422), a leveling pivot hole (423) and a through hole (424). The lever pivot holes (422) are aligned with each other and are connected pivotally to the rear end of the lever (20). The leveling pivot holes (423) are aligned with each other. The through holes (424) are aligned with each other. The pin (425) is mounted in the two through holes (424).

The leveling rod (30) is connected parallel to the lever (20) and pivotally to the leveling rod pivot holes (133) in the bracket (13) and the leveling pivot holes (423) in the wings (421) on the mounting bracket (42).

The resilient element (50) is mounted between the pad (40) and the base (10), may be a spring and has an upper end and a lower end. The upper end of the resilient element (50) is attached to the pin (425). The lower end is attached to the connector (14) on the base (10).

Figure 6:
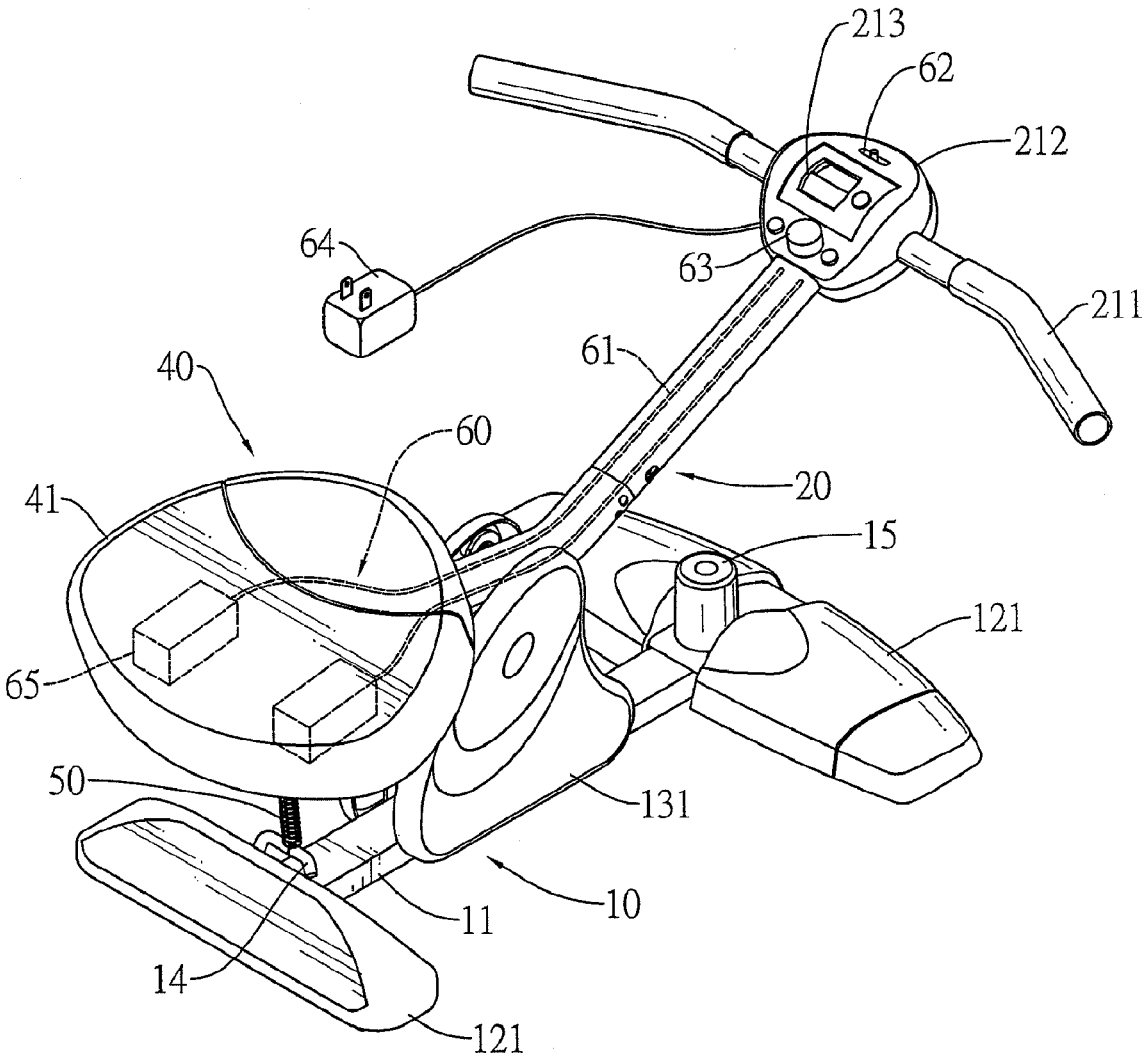
FIG. 6 is a perspective view of the exercise machine in FIG. 1 with a controlling system embedded in the lever.
Figure 7:
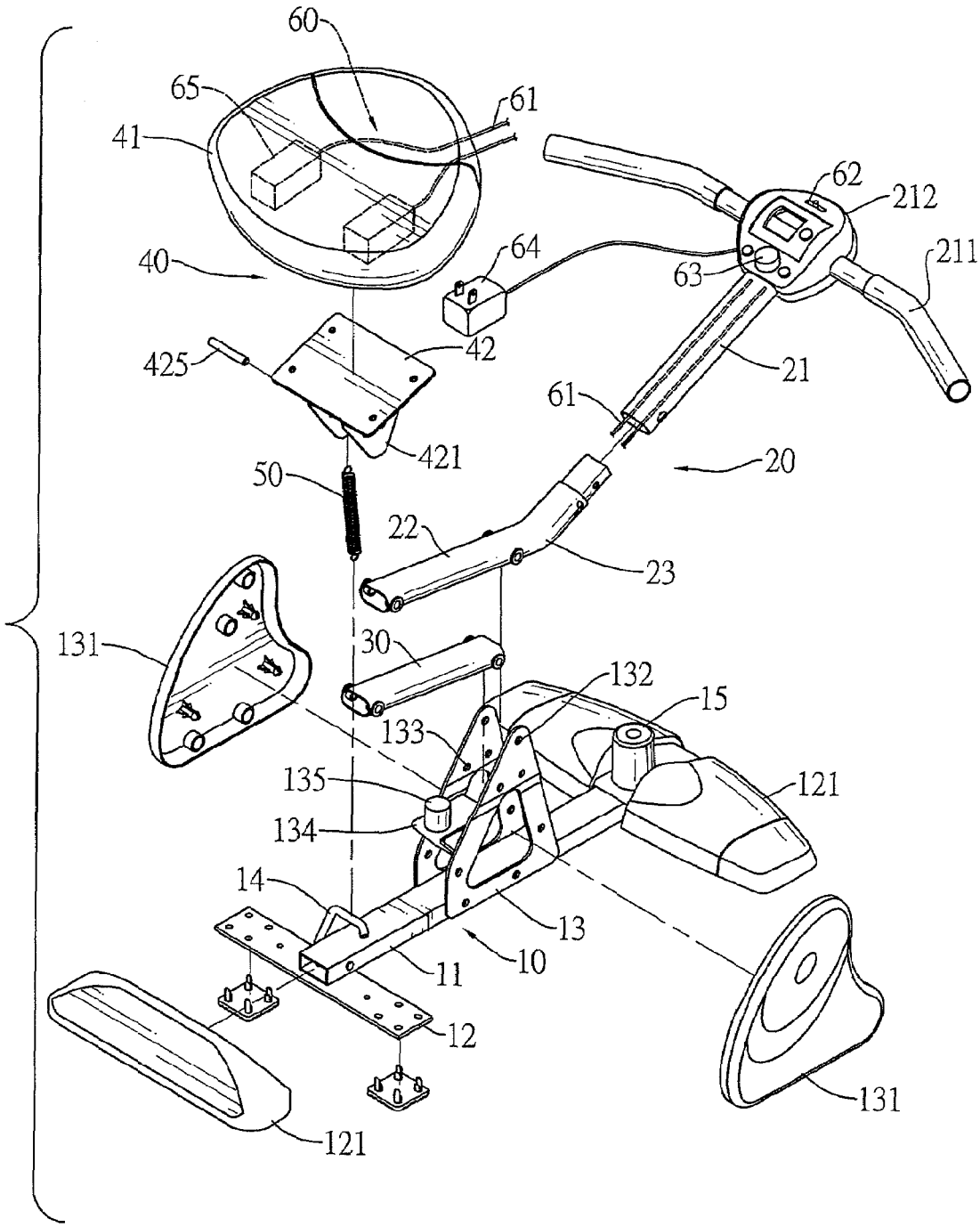
FIG. 7 is an exploded perspective view of the exercise machine in FIG. 6.

With further reference to FIGS. 6 and 7, the vibrator (65) is attached to the bottom surface of the pad body (41) and has a controlling system (60). The controlling system (60) controls the operation of the at least one vibrator (65) and comprises a power regulator (64), an electrical cable (61), an optional switch (62) and an optional rheostat (63). The power regulator (64) connects selectively to an external power supply, transforms and converts external power and supplies electrical power to the at least one vibrator (65). The electrical cable (61) connects the power regulator (64) to the at least one vibrator (65) and may extend through the box (212) and be mounted in the lever (20) or may be connected directly from the power regulator (64) to the at least one vibrator (65). The switch (62) is mounted in the electrical cable (61), turns the at least one vibrator (65) on or off and may be mounted in the box (212). The rheostat (63) is mounted in the electrical cable (61), controls how much power is sent to the at least one vibrator (65) and how much the at least one vibrator (65) vibrates and may be mounted in the box (212).

Figure 8:
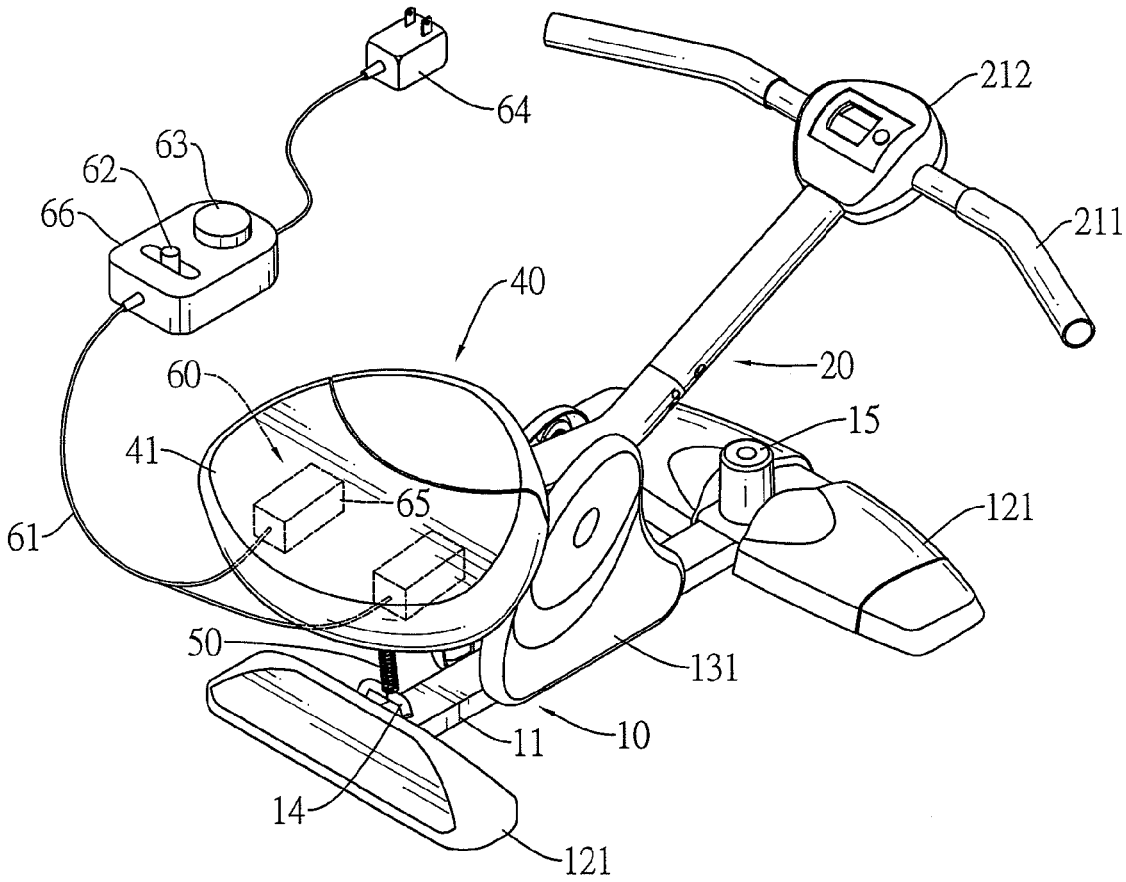
FIG. 8 is a perspective view of the exercise machine in FIG. 6 with the controlling system connected to the at least one vibrator externally.

With reference to FIG. 8, the controlling system (60) may be connected to the at least one vibrator (65) externally with the switch (62) and the rheostat (63) set in a control housing (66). The control housing (66) is mounted in line with the electrical cable (61) between the power regulator (64) and the at least one vibrator (65) and houses the switch (62) and the rheostat (63).

To use the exercise machine, a person places his or her abdomen on the pad body (41) and grasps the handlebar (211). When the person leans his or her body weight forward, the front end of the lever (20) lowers and applies a significant percentage of the body weight to the user's triceps muscles. When the person lean his or her body weight backward, the front end of the lever (20) rises, and weight is released from the triceps muscles. When the triceps muscles become sore or experience pain, the can easily release weight from the triceps muscles without injuring the muscles.

The exercise machine in accordance with the present invention helps an exerciser to safely perform an exercise similar to push-ups.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exercise machine comprising
a base having
a base bar having
a top;
a front end; and
a rear end;
two crossbars being attached respectively to the front end and the rear end of the base bar;
a bracket being attached to and protruding up from the base bar between the front end and the rear end of the base bar and having
two sides;
a lever pivot hole; and
a leveling rod pivot hole; and
a connector being attached to and protruding up from the base bar near the rear end;
a lever being attached pivotally to the lever pivot hole in the bracket and having
a front end;
a rear end; and
a handlebar being attached to the front end of the lever;
a pad being attached to the rear end of the lever and having
a pad body having a bottom surface; and
a mounting bracket being attached to the bottom surface of the pad body, connecting the pad body to the lever and having
two wings protruding down and being connected pivotally to the rear end of the lever, and each wing having
a lever pivot hole, wherein the lever pivot holes of the wings are aligned with each other and are connected pivotally to the rear end of the lever;
a leveling pivot hole, wherein the leveling pivot holes of the wings are aligned with each other; and
a through hole, wherein the through holes of the wings are aligned with each other; and
a pin being mounted in the two through holes in the wings;
a leveling rod being connected parallel to the lever and pivotally to the leveling rod pivot holes in the bracket and the leveling pivot holes in the wings; and
a resilient element being mounted between the pad and the base and having
an upper end being attached to the pin; and
a lower end being attached to the connector on the base.

2. The exercise machine as claimed in claim 1, wherein the handlebar further has a box.

3. The exercise machine as claimed in claim 1, wherein the base further has a bumper attached to and protruding up from the top of the base bar near the front end.

4. The exercise machine as claimed in claim 1, wherein the crossbars further have a set of covers respectively covering the two crossbars.

5. The exercise machine as claimed in claim 1, wherein the bracket further has two side covers mounted respectively on the sides of the bracket.

6. The exercise machine as claimed in claim 1, wherein the bracket further has
a bumper seat attached to the bracket and having a top; and
a secondary bumper attached to and protruding up from the top of the bumper seat.

7. The exercise machine as claimed in claim 1, wherein the connector is a hook.

8. The exercise machine as claimed in claim 1, wherein the lever has a front segment and a rear segment.

9. The exercise machine as claimed in claim 1, wherein the resilient element is a spring.

10. The exercise machine as claimed in claim 2, wherein the box has a counter.

11. The exercise machine as claimed in claim 2, wherein the exercise machine further has at least one vibrator attached to the bottom surface of the pad body; and a controlling system controlling the cooperation of the at least one vibrator and comprising a power regulator electrically connecting selectively to an external power supply to transform and convert an external power and to supply an electrical power to the at least one vibrator; and an electrical cable connecting the power regulator to the at least one vibrator.

12. The exercise machine as claimed in claim 11, wherein the controlling system further has a switch mounted in the electrical cable to turn the at least one vibrator on or off;

a rheostat mounted in the electrical cable to control how much power is sent to the at least one vibrator and how much the at least one vibrator vibrates.

13. The exercise machine as claimed in claim 12, wherein the electrical cable extends through the lever and is mounted in the box;

the switch is mounted in the box; and the rheostat is mounted in the box.

14. The exercise machine as claimed in claim 12, wherein the electrical cable is connected directly from the power regulator to the at least one vibrator.

15. The exercise machine as claimed in claim 11, wherein the electrical cable extends through the lever and is mounted in the box.

16. The exercise machine as claimed in claim 11, wherein the electrical cable is connected directly from the power regulator to the at least one vibrator.

* * * * *